US009162282B2

(12) United States Patent
Takada

(10) Patent No.: US 9,162,282 B2
(45) Date of Patent: Oct. 20, 2015

(54) CASTING APPARATUS

(75) Inventor: Noboru Takada, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 818 days.

(21) Appl. No.: 12/397,045

(22) Filed: Mar. 3, 2009

(65) Prior Publication Data

US 2009/0229782 A1 Sep. 17, 2009

(30) Foreign Application Priority Data

Mar. 11, 2008 (JP) ..... 2008-061877

(51) Int. Cl.
*B22D 23/00* (2006.01)
*B22D 27/13* (2006.01)
*B22D 27/15* (2006.01)

(52) U.S. Cl.
CPC ..... *B22D 23/006* (2013.01); *B22D 27/13* (2013.01); *B22D 27/15* (2013.01)

(58) Field of Classification Search
CPC ..... B22D 23/006; B22D 27/15; B22D 27/13
USPC ..... 164/136, 336–337
See application file for complete search history.

(56) References Cited

U.S. PATENT DOCUMENTS

| | | | | | |
|---|---|---|---|---|---|
| 3,987,844 | A | * | 10/1976 | Vitanov et al. | 164/256 |
| 4,146,081 | A | * | 3/1979 | Reis | 164/155.5 |
| 4,412,804 | A | * | 11/1983 | Huther | 425/546 |
| 5,151,200 | A | * | 9/1992 | Stephansky et al. | 222/590 |
| 5,819,837 | A | * | 10/1998 | Hugo et al. | 164/61 |
| 5,906,235 | A | * | 5/1999 | Thomas et al. | 164/120 |

FOREIGN PATENT DOCUMENTS

| | | | | |
|---|---|---|---|---|
| JP | 49-114522 | A | | 11/1974 |
| JP | 52-120229 | A | | 10/1977 |
| JP | 09225622 | A | * | 9/1997 |
| JP | 2006130537 | A | * | 5/2006 |
| JP | A 2006-130537 | | | 5/2006 |

OTHER PUBLICATIONS

Machine translation of Enokido (JP 2006-130537A, cited in IDS).*

* cited by examiner

*Primary Examiner* — Kevin P Kerns
*Assistant Examiner* — Jacky Yuen
(74) *Attorney, Agent, or Firm* — Greer Burns & Crain Ltd.

(57) ABSTRACT

Provided is a compact casting apparatus capable of producing a high-quality casted product. While the internal pressures of a mold and a hopper are directly reduced by depressurizing means through a pipe and a branch pipe, the mold and the hopper are gradually tilted to fill the mold with a molten metal accommodated in the hopper. After the filling is completed, an open-close gate closes a runner. The molten metal is solidified with only the mold being directly pressured by pressurizing means through the pipe.

8 Claims, 5 Drawing Sheets

CASTING APPARATUS

BACKGROUND OF THE INVENTION

1. Field of the Invention

The present invention relates to a casting apparatus, and more specifically, to a compact casting apparatus capable of producing a high-quality casted product.

2. Description of the Related Art

A tilt-casting method is known as a method for producing a mold such as a tire mold. Conventionally, an apparatus having a hermetically sealable tilting tank has been used in the tilt-casting method. The tank houses inside a mold provided with a plaster mold therein and a hopper for accommodating a molten metal such as an aluminium material (see, for example, Japanese patent application Kokai publication No. 2006-130537). In order to prevent the formation of pores in a casted product, the tilting tank is tilted with the internal pressure being reduced. Accordingly, the mold and the hopper are gradually tilted from the horizontal positions to fill the mold with the molten metal in the hopper. After the molten metal is completely filled into the mold, the internal pressure of the tilting tank is increased to a predetermined pressure. Thus, the molten metal is solidified with its fillingness increased. Subsequently, after the tilting tank is returned to the horizontal position, the mold is taken outside the tilting tank. In this manner, a casted product solidified into a predetermined shape is obtained from the mold.

The tilting tank needs to have an enough space to accommodate the mold and the hopper as described above. Consequently, the conventional casting apparatus is large sized, and it has been difficult to make a compact casting apparatus. Therefore, a compact casting apparatus capable of producing a high-quality casted product has been demanded.

SUMMARY OF THE INVENTION

An object of the present invention is to provide a compact casting apparatus capable of producing a high-quality casted product.

To accomplish the above object, a casting apparatus of the present invention includes: a hopper which accommodates a molten metal; a mold which communicates with the hopper through a runner; and tilting means which tilts the hopper and the mold. The hopper and the mold are connected to depressurizing means through pipes. The mold is connected to pressurizing means through a pipe. The mold is provided with an open-close gate which opens and closes the runner.

The casting apparatus maybe provided with a single unit of depressurizing means. The single unit of depressurizing means is connected to the mold through the pipe. The pipe is connected to the hopper through a branch pipe having an open-close valve; accordingly, the single unit of depressurizing means is connected to the hopper and the mold through the pipe and the branching pipe. The pipe connecting the single depressurizing means to the mold is connected to the pressurizing means through a switch valve; accordingly, the mold is connected to the pressurizing means through the pipe. Moreover, the casting apparatus may have the following structure. Specifically, the mold is connected to the hopper with a seal member interposed therebetween. A seal member is provided to a joint surface between an upper mold and a lower mold of the mold. A seal member is provided to a joint surface between a body part and a lid part of the hopper.

In the present invention, the hopper and the mold are connected to the depressurizing means through the pipes, and the mold is connected to the pressurizing means through the pipe and provided with the open-close gate which opens and closes the runner. Accordingly, the internal pressures of the mold and the hopper are directly reduced by the depressurizing means, and only the mold is directly pressured by the pressurizing means. Therefore, a tilting tank as large as the one in the conventional technique is no longer necessary, and the casting apparatus according to the present invention can have a compact structure.

Furthermore, a molten metal accommodated in the hopper under a reduced pressure is filled into the mold, and the molten metal thus filled in the mold is solidified while being pressured at a predetermined pressure. Thereby, a high-quality casted product is obtained.

DETAILED DESCRIPTION OF THE PREFERRED EMBODIMENT

Figure 1:
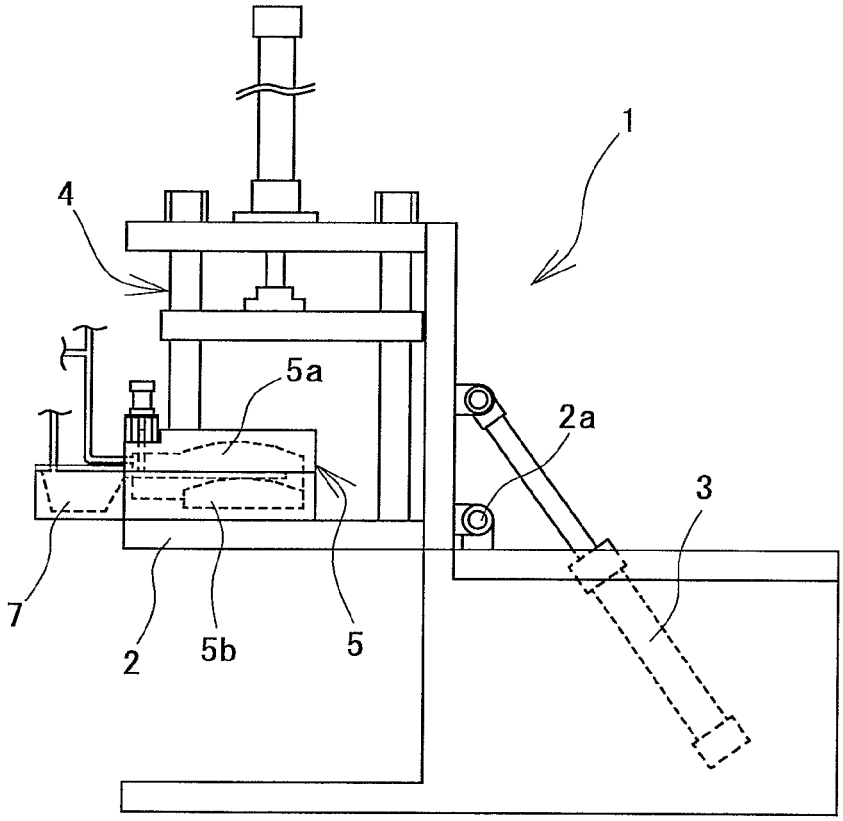
FIG. 1 is a side view for exemplifying a casting apparatus of the present invention.

Hereinafter, a casting apparatus of the present invention will be described on the basis of an embodiment illustrated in the drawings.

Figure 2:
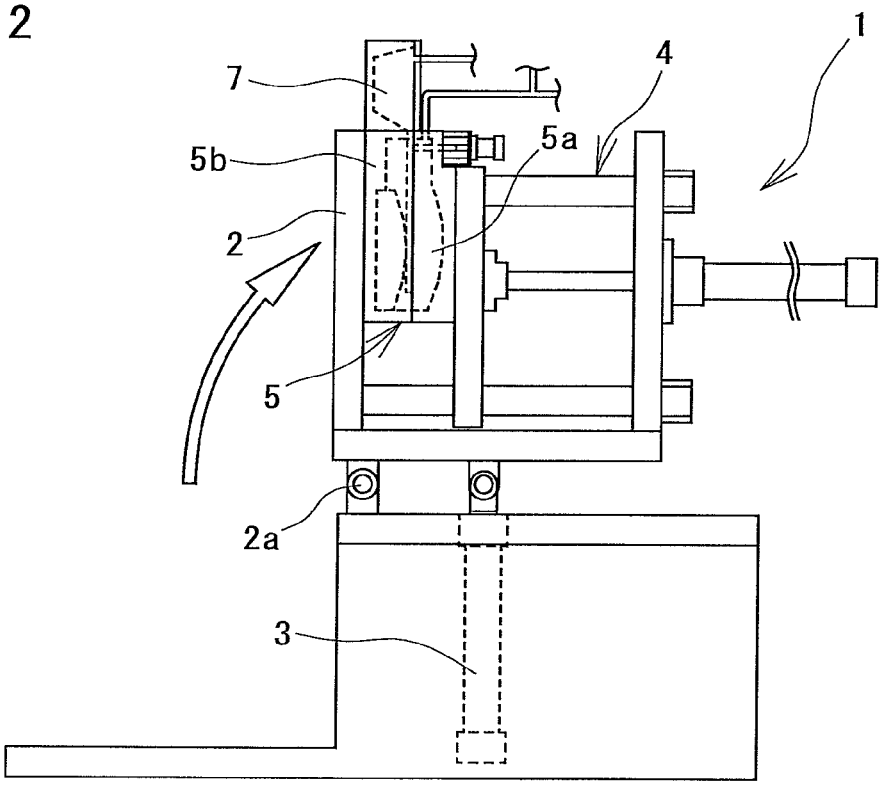
FIG. 2 is a side view of the casting apparatus for exemplifying that a mold shown in FIG. 1 is tilted.

As exemplified in FIG. 1, a casting apparatus 1 of the present invention includes a mounting support 2 and a fixing member 4. The fixing member 4 is formed of a pressing plate or the like, and is elevated up or down by an elevating cylinder. A hopper 7 and a mold 5 are mounted on the mounting support 2, and are integrally fixed thereto by the fixing member 4. The mounting support 2 tilts around a rotation shaft 2*a* in accordance with the back and forth movement of a rod of a tilting cylinder 3. The tilting angle of the mounting support 2 by the tilting cylinder 3 can be set freely within a range of, for example, 0° (horizontal) to 90° (vertical). As the mounting support 2 tilts to the vertical position, the mold 5 and the hopper 7 also tilt integrally from the horizontal positions to the vertical positions as exemplified in FIG. 2.

Figure 3:
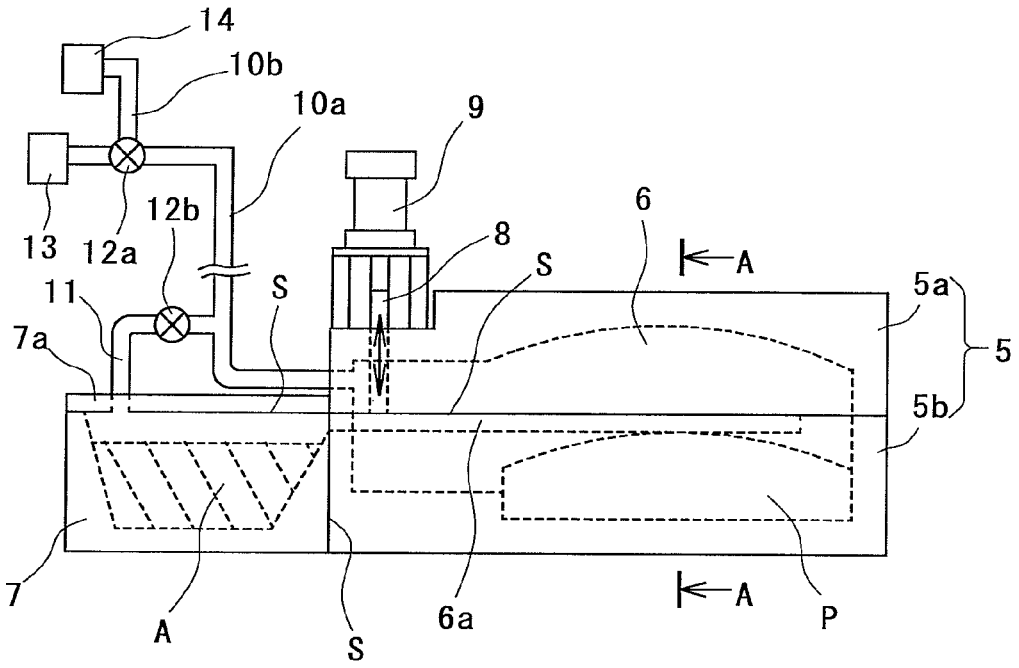
FIG. 3 is a side view for exemplifying the mold and a hopper shown in FIG. 1.
Figure 4:
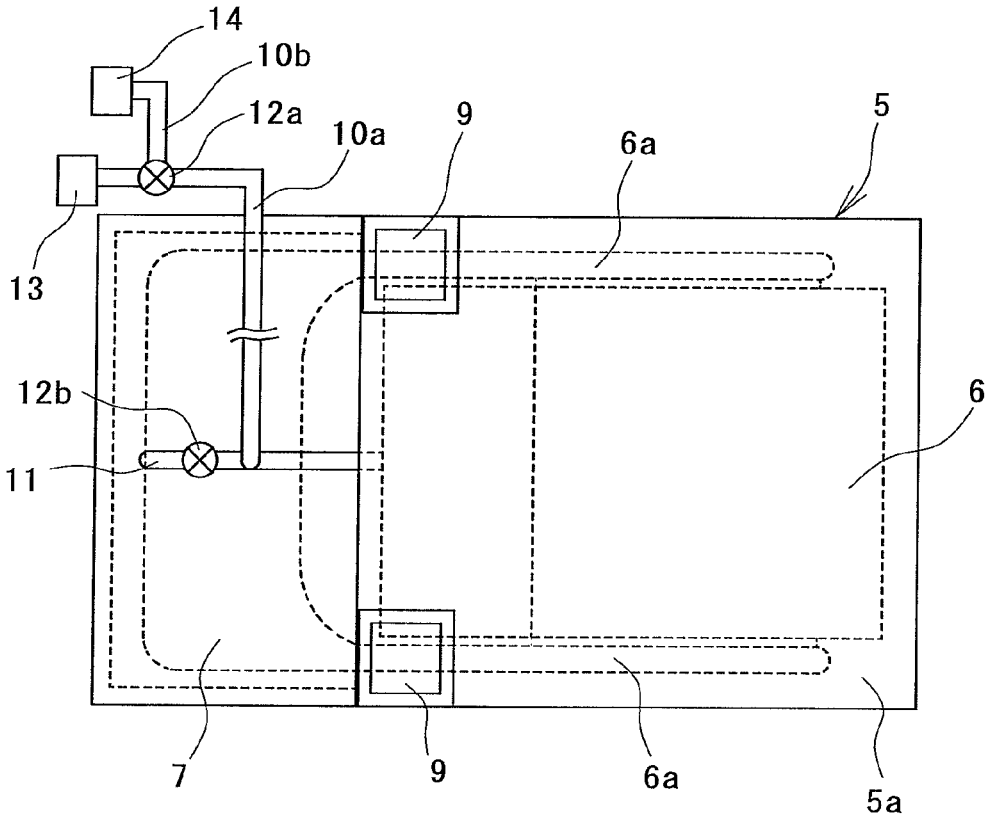
FIG. 4 is a plan view of FIG. 3
Figure 5:
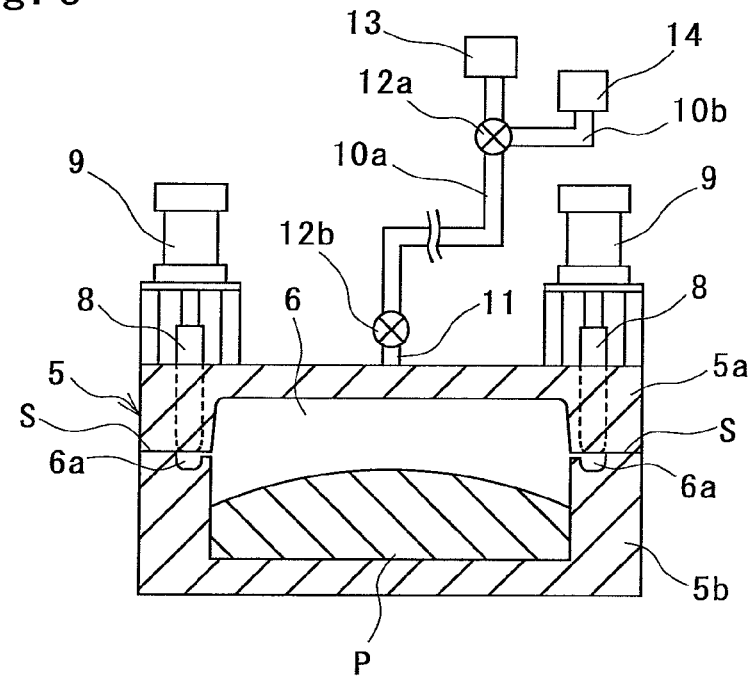
FIG. 5 is a cross-sectional view taken along the line A-A in FIG. 3.

As exemplified in FIG. 3 to FIG. 5, the mold 5 is divided into two parts of an upper mold 5*a* and a lower mold 5*b*. The space formed by the upper mold 5*a* and the lower mold 5*b* is a cavity 6. A plaster mold P formed into a predetermined shape is provided in the cavity 6. A seal member S is provided to the joint surface between the upper mold 5*a* and the lower mold 5*b*, keeping the air tightness high.

Runners 6*a* are formed in the lower mold 5*b* along the joint surface between the upper mold 5*a* and the lower mold 5*b*. Through the runners 6*a*, the inside (cavity 6) of the mold 5 communicates with the inside of the hopper 7. Open-close gates 8 which open or close the runners 6*a* is provided to the mold 5. The open-close gates 8 close the runners 6*a* by the forward movement of rods of gate cylinders 9, and open the runners 6*a* by the reverse movement.

The hopper 7 temporarily accommodates a predetermined amount of a molten metal A such as an aluminium material. The seal member S is provided to the joint surface between a body part and a lid 7*a* of the hopper 7, keeping the air tightness high. Moreover, the seal member S is provided to the joint surface between the mold 5 and the hopper 7, keeping the air tightness high, while connecting the two.

The mold 5 is connected to depressurizing means 13 such as a vacuum pump through a pipe 10*a*. The pipe 10*a* is connected to one end of a branch pipe 11 that has an open-close valve 12*b*. The other end of the branch pipe 11 is connected to the hopper 7. In other words, the hopper 7 is connected to the depressurizing means 13 through the branch pipe 11 and the pipe 10*a*.

Furthermore, the pipe 10*a* that connects the mold 5 to the depressurizing means 13 is connected to a pipe 10*b* through a switch valve 12*a*, the pipe 10*b* being connected to pressurizing means 14 such as a pressure pump. In other words, the mold 5 is connected to the pressurizing means 14 through the pipe 10*b* and the pipe 10*a*.

Next, the procedure of a casting method with the casting apparatus 1 will be described.

First, as exemplified in FIG. 1, the mold 5 and the hopper 7 are horizontally set on the mounting support 2 of the casting apparatus 1 with the molten metal A being accommodated in the hopper 7 as exemplified in FIG. 3. At this moment, the open-close gates 8 are raised so as not to shut off the runners 6*a*.

Figure 6:
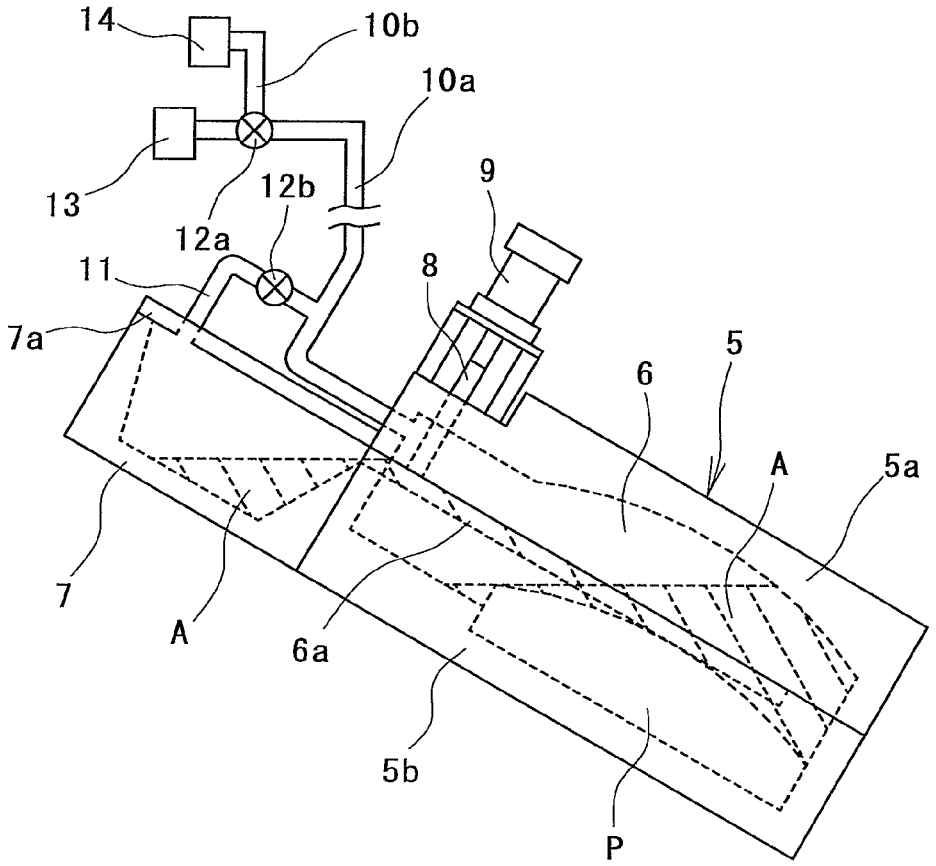
FIG. 6 is a side view for exemplifying that the mold shown in FIG. 3 is tilted.

Then, by operating the tilting cylinder 3, the mold 5 and the hopper 7 are gradually tilted as exemplified in FIG. 6. Thus, the molten metal A is caused to flow from the hopper 7 into the cavity 6 of the mold 5 through the runners 6*a*. As the tilting cylinder 3 starts the tilting movement in this manner, the internal pressure of the hopper 7 and the mold 5 are reduced. This reduction in pressure is accomplished by: operating the depressurizing means 13; controlling the switch valve 12*a* so that the communication between the pressurizing means 14 and the pipe 10*a* can be shut off to thereby make only the depressurizing means 13 effective; and controlling the open-close valve 12*b* so that the pipe 10*a* can communicate with the branch pipe 11.

In this manner, the internal pressure of the hopper 7 is reduced by the depressurizing means 13 through the pipe 10*a* and the branch pipe 11, and the internal pressure of the mold 5 is reduced by the depressurizing means 13 through the pipe 10*a*. The internal pressures of the hopper 7 and the mold 5 are reduced down to approximately, for example, 30 kPa to 50 kPa abs (atmospheric pressure is 101.32 kPa abs). This enables the micro-production (specific design) of a casted product D, preventing the formation of pores therein.

Figure 7:
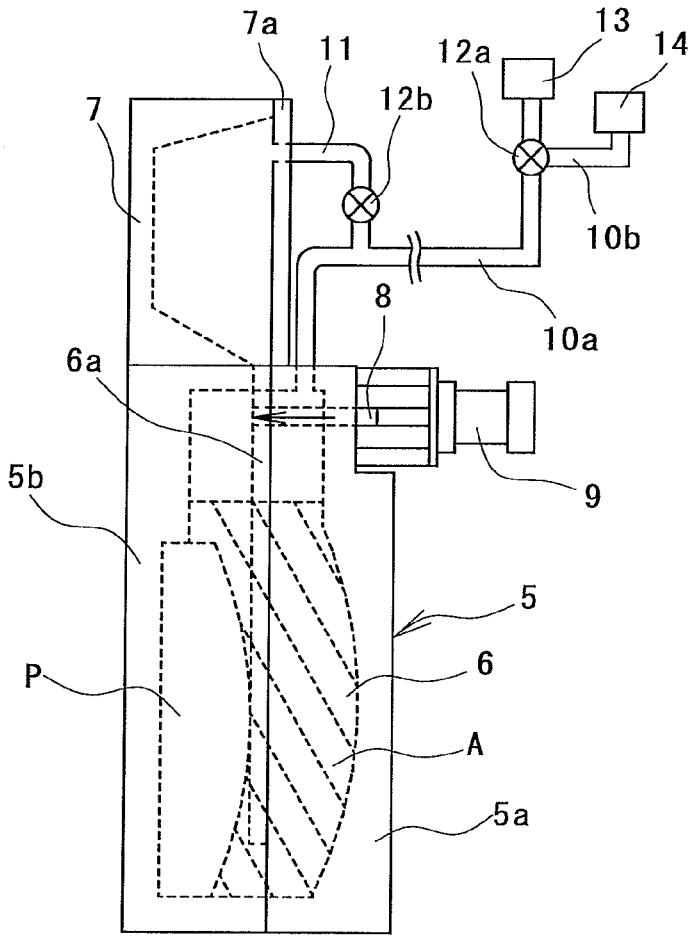
FIG. 7 is a side view for exemplifying that the mold shown in FIG. 6 is further tilted to a vertical position.

Subsequently, as exemplified in FIG. 7, the mold 5 and the hopper 7 are tilted up to a predetermined angle (in this embodiment, approximately 90°). The molten metal A accommodated in the hopper 7 under such a reduced pressure is then filled into the cavity 6 of the mold 5 through the runners 6*a*. An oxide film is formed on the surface of the molten metal A in contact with the air. By gradually tilting the mold 5 and the hopper 7, the oxide film can be kept on top of the molten metal A when the molten metal A is filled into the mold 5. This prevents the oxide film from mixing into a portion of the molten metal A to serve as a product later, and thus a high-quality casted product can be obtained.

After the filling of the molten metal A into the mold 5 is completed, only the internal pressure of the mold 5 is increased up to a predetermined pressure. To this end, the pressurizing means 14 is operated and the switch valve 12*a* is controlled so that the communication between the depressurizing means 13 and the pipe 10*a* can be shut off to thereby make only the pressurizing means 14 work. The depressurizing means 13 that has been in operation is stopped. Moreover, the open-close valve 12*b* is controlled so that the communication between the pipe 10*a* and the branch pipe 11 can be shut off. Furthermore, the gate cylinders 9 are operated to cause the open-close gates 8 to close the runners 6*a*. In this way, the pressuring means 14 applies the pressure only to the inside of the mold 5 through the pipe 10*b* and the pipe 10*a*. Thus, the molten metal A is provided as a riser during casting. The pressure applied by the pressurizing means 14 is set approximately, for example, 0.01 MPa to 1.0 MPa, and preferably 0.3 MPa to 0.6 MPa. Here, air or an inert gas is used as the gas to increase the internal pressure.

As described above, only the internal pressure of the mold 5 is increased, and the molten metal A thus filled is solidified. In this manner, the fillingness is increased, and the quality of the casted product D thus produced is improved. In this embodiment, the molten metal A is solidified upon contact with the mold 5, while the seal member S keeps the air tightness in the mold 5 high. Accordingly, the air tightness is further improved, and the pressurizing process is conducted efficiently.

Figure 8:
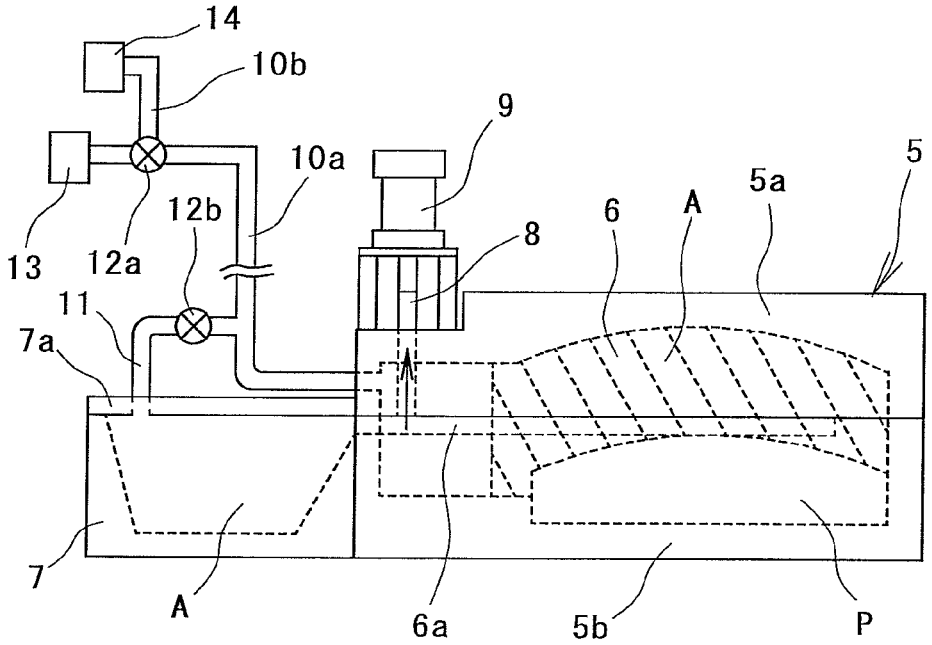
FIG. 8 is a side view for exemplifying that the mold shown in FIG. 7 is returned to a horizontal position.
Figure 9:
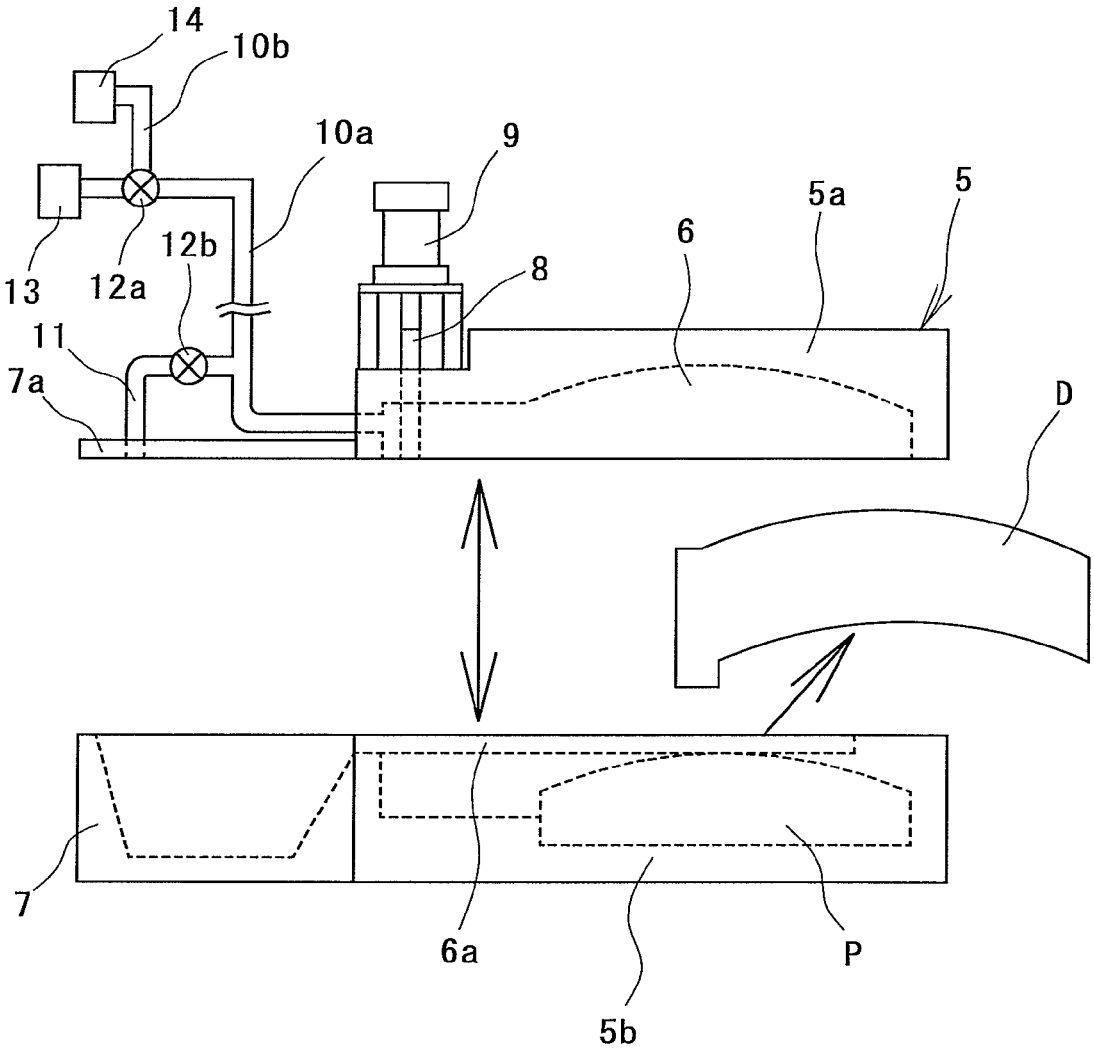
FIG. 9 is a side view for exemplifying that the mold shown in FIG. 8 is opened.

After the molten metal A is completely solidified, the increasing of the internal pressure of the mold 5 by the pressurizing means 14 is stopped. Then, the mold 5 and the hopper 7 are returned to the horizontal positions as exemplified in FIG. 8. Subsequently, as exemplified in FIG. 9, the mold 5 is divided into the upper mold 5*a* and the lower mold 5*b*, and thus opened. Then, the casted product D solidified into a predetermined shape is taken out from the mold 5. In this embodiment, as the mold 5 is opened, the hopper 7 is also divided into the body part and the lid part 7*a*. Thus, a casted product D (for example, a tire mold) of a predetermined shape is obtained.

In the present invention, the internal pressures of the mold 5 and the hopper 7 are directly reduced by the depressurizing means 13, and only the mold 5 is directly pressured by the pressurizing means 14. Thus, the tilting tank is no longer as large as the one in the conventional technique, and the casting apparatus according to the present invention can have a compact structure. Moreover, the quality of the casted product D can be improved, as has described above.

What is claimed is:

1. A casting apparatus comprising:

a hopper which accommodates molten metal;

a mold which communicates with the hopper through a runner;

wherein the mold includes a cavity formed internally therein;

wherein the runner is formed in the mold so as to extend through the hopper and extends toward the lower end portion of the cavity such that the runner extends adjacent a side portion of the cavity;

a mounting support structure configured to support the hopper and the mold thereon without enclosing the hopper and the mold inside the mounting support structure;

tilting means which tilts the hopper and the mold while the hopper and the mold are supported on the mounting support structure;

depressurizing means in fluid communication with the hopper and the mold for depressurizing inside the hopper and the mold;

an open-close gate, within the mold, which opens and closes the runner;

pressurizing means in fluid communication with the mold for applying predetermined pressure directly inside the cavity of the mold, without applying the predetermined pressure to the hopper, when the open-close gate is closed;

wherein:

the depressurizing means is provided as a single unit, the single unit of depressurizing means is connected to the mold through a first pipe, the first pipe is connected to the hopper through a branch pipe having an open-close valve, whereby the single unit of depressurizing means is connected to the hopper and the mold through the first pipe and the branching pipe, the first pipe connecting the single depressurizing means to the mold is in fluid communication with the pressurizing means through a switch valve, whereby the mold is connected to the pressurizing means through the first pipe.

2. The casting apparatus according to claim 1, wherein the mold is connected to the hopper with a seal member interposed therebetween, wherein a seal member is provided at a joint surface between an upper mold and a lower mold of the mold, such that the predetermined pressure can be maintained within the cavity of the mold without escaping outside of the mold, and wherein a seal member is provided at a joint surface between a body part and a lid part of the hopper.

3. The casting apparatus according to claim 2, wherein:

the first pipe depressurizes said mold via a flow in a first direction, and the molten metal flowing from the hopper to the mold, when the hopper and mold are tilted, flows in a second direction, with the second direction being opposite of the first direction.

4. The casting apparatus according to claim 1, further comprising:

a fixing member including a pressing plate and an elevating cylinder for fixing said mold into a closed position, even when said tilting means tilts the hopper and the mold.

5. The casting apparatus according to claim 4, wherein said tilting means includes a tilting cylinder and a rod that is rotatably connected to said mounting support at a pivot point, and further wherein said mounting support tilts from a horizontal position to a tilted position about a rotation shaft when said rod is retracted into said tilting cylinder.

6. A method of casting with a casting apparatus, wherein the casting apparatus includes a hopper which accommodates molten metal; a mold which communicates with the hopper through a runner, wherein the mold includes a cavity formed internally therein and wherein the runner is formed in the mold so as to extend through the hopper and extends toward the lower end portion of the cavity such that the runner extends adjacent a side portion of the cavity; a mounting support structure configured to support the hopper and the mold thereon without enclosing the hopper and the mold inside the mounting support structure; tilting means which tilts the hopper and the mold while the hopper and the mold are supported on the mounting support structure; depressurizing means in fluid communication with the hopper and the mold for depressurizing inside the hopper and the mold; an open-close gate, within the mold, which opens and closes the runner; pressurizing means in fluid communication with the mold for applying predetermined pressure directly inside the cavity of the mold, without applying the predetermined pressure to the hopper, when the open-close gate is closed; wherein: the depressurizing means is provided as a single unit, the single unit of depressurizing means is connected to the mold through a first pipe, the first pipe is connected to the hopper through a branch pipe having an open-close valve, whereby the single unit of depressurizing means is connected to the hopper and the mold through the first pipe and the branching pipe, the first pipe connecting the single depressurizing means to the mold is in fluid communication with the pressurizing means through a switch valve, whereby the mold is connected to the pressurizing means through the first pipe, the method comprising:

providing the hopper with molten metal with the hopper and mold being in a horizontal position;

operating the tilting means to tilt the hopper and mold such that the molten metal starts to flow from the hopper to a cavity of the mold through the runners;

reducing the internal pressure of the hopper and the mold, via the depressurizing means, during the step of operating the tilting means;

continuing to tilt the hopper and the mold to a predetermined angle such that all of the molten metal in the hopper flows into the mold;

closing said open-close gate to close the runner;

using said pressurizing means to increase the pressure within the interior of the mold, without applying pressure to the interior of the hopper; and allowing the molten metal to solidify and form a casted product.

7. The method according to claim 6, further comprising the step of allowing an oxide film to be formed on the surface of the molten metal via contact with air, and maintaining said oxide film on an upper surface of said molten metal by performing said tilting step gradually.

8. The method according to claim 6, wherein the mold is connected to the hopper with a first seal member interposed therebetween; a second seal member provided at a joint surface between an upper mold and a lower mold of the mold, such that the predetermined pressure can be maintained within the cavity of the mold without escaping outside of the mold; and a third seal member provided at a joint surface between a body part and a lid part of the hopper.

* * * * *